US007008125B2

(12) United States Patent
Nunokawa et al.

(10) Patent No.: US 7,008,125 B2
(45) Date of Patent: Mar. 7, 2006

(54) PRINTING DEVICE

(75) Inventors: Hirokazu Nunokawa, Nagano-ken (JP); Yasuhiko Kosugi, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 10/221,506

(22) PCT Filed: Dec. 26, 2001

(86) PCT No.: PCT/JP01/11501

§ 371 (c)(1),
(2), (4) Date: Sep. 13, 2002

(87) PCT Pub. No.: WO02/053389

PCT Pub. Date: Jul. 11, 2002

(65) Prior Publication Data

US 2003/0077098 A1 Apr. 24, 2003

(30) Foreign Application Priority Data

Dec. 27, 2000 (JP) ..... 2000-397634

(51) Int. Cl.
*B41J 21/17* (2006.01)
*B41J 11/42* (2006.01)
*B41J 33/14* (2006.01)
*B41J 17/00* (2006.01)

(52) U.S. Cl. ..... 400/70; 400/582; 400/234; 400/618; 347/215

(58) Field of Classification Search ..... 400/70, 400/62, 103, 621, 582, 234, 618; 358/1.12; 399/23; 101/484, 35; 347/19, 334.2, 33, 347/14

See application file for complete search history.

(56) References Cited

U.S. PATENT DOCUMENTS 4,726,532 A * 2/1988 Holm ..... 242/520
4,788,558 A * 11/1988 Caldwell et al. ..... 347/215
5,160,098 A * 11/1992 Durkos ..... 242/413.2
5,251,891 A * 10/1993 Blaser et al. ..... 271/176
5,402,353 A * 3/1995 Laplante et al. ..... 700/126
5,529,410 A * 6/1996 Hunter et al. ..... 400/234
5,531,396 A * 7/1996 Kinnunen et al. ..... 242/526.3
5,744,732 A * 4/1998 Kubby et al. ..... 73/865
5,918,989 A * 7/1999 Stout, Jr. et al. ..... 400/88
5,992,739 A * 11/1999 Maeder ..... 235/383
6,045,211 A * 4/2000 Tokuda ..... 347/33

(Continued)

FOREIGN PATENT DOCUMENTS

JP 5-177907 A 7/1993

(Continued)

OTHER PUBLICATIONS

The IEEE Standard Dictionary of Electrical and Electronics Terms, sixth edition, Apr. 8, 1997, p. 863.*

*Primary Examiner*—Andrew H. Hirshfeld
*Assistant Examiner*—Wasseem H. Hamdan
(74) *Attorney, Agent, or Firm*—Sughrue Mion, PLLC

(57) ABSTRACT

An IC memory module 33 for storing paper-related information is embedded in a core 31 of a roll paper member 30. A control circuit 50 accesses the IC memory module 33 embedded in the core 31 of roll paper member 30 via a transmission-reception antenna 202 at a timing, for example, when a power source is turned on, the roll paper member 30 is replaced, and power source is turned off, and acquires the paper-related information. The control circuit 50 controls the printing processing by taking account of the information acquired from the IC memory module 33.

9 Claims, 10 Drawing Sheets

U.S. PATENT DOCUMENTS

| | | | | |
|---|---|---|---|---|
| 6,047,275 | A * | 4/2000 | Jaremko et al. | 706/1 |
| 6,149,325 | A | 11/2000 | Nunokawa et al. | 400/208 |
| 6,210,052 | B1 * | 4/2001 | Smith | 400/62 |
| 6,246,326 | B1 * | 6/2001 | Wiklof et al. | 340/572.1 |
| 6,327,972 | B1 * | 12/2001 | Heredia et al. | 101/35 |
| 6,353,479 | B1 * | 3/2002 | Lubawy et al. | 358/1.13 |
| 6,402,081 | B1 * | 6/2002 | Rautakorpi et al. | 242/534 |
| 6,530,519 | B1 * | 3/2003 | Suzuki | 235/375 |
| 6,584,366 | B1 * | 6/2003 | Liepold et al. | 700/48 |

FOREIGN PATENT DOCUMENTS

| | | | |
|---|---|---|---|
| JP | 10025046 | * | 1/1998 |
| JP | 10-254200 | | 9/1998 |
| JP | 11016080 | * | 1/1999 |
| JP | 2000-219432 A | | 8/2000 |
| JP | 2000-281268 A | | 10/2000 |
| JP | 2000-355146 A | | 12/2000 |
| WO | WO 98/05508 | * | 8/1996 |
| WO | WO 98/52762 A2 | | 11/1998 |

* cited by examiner

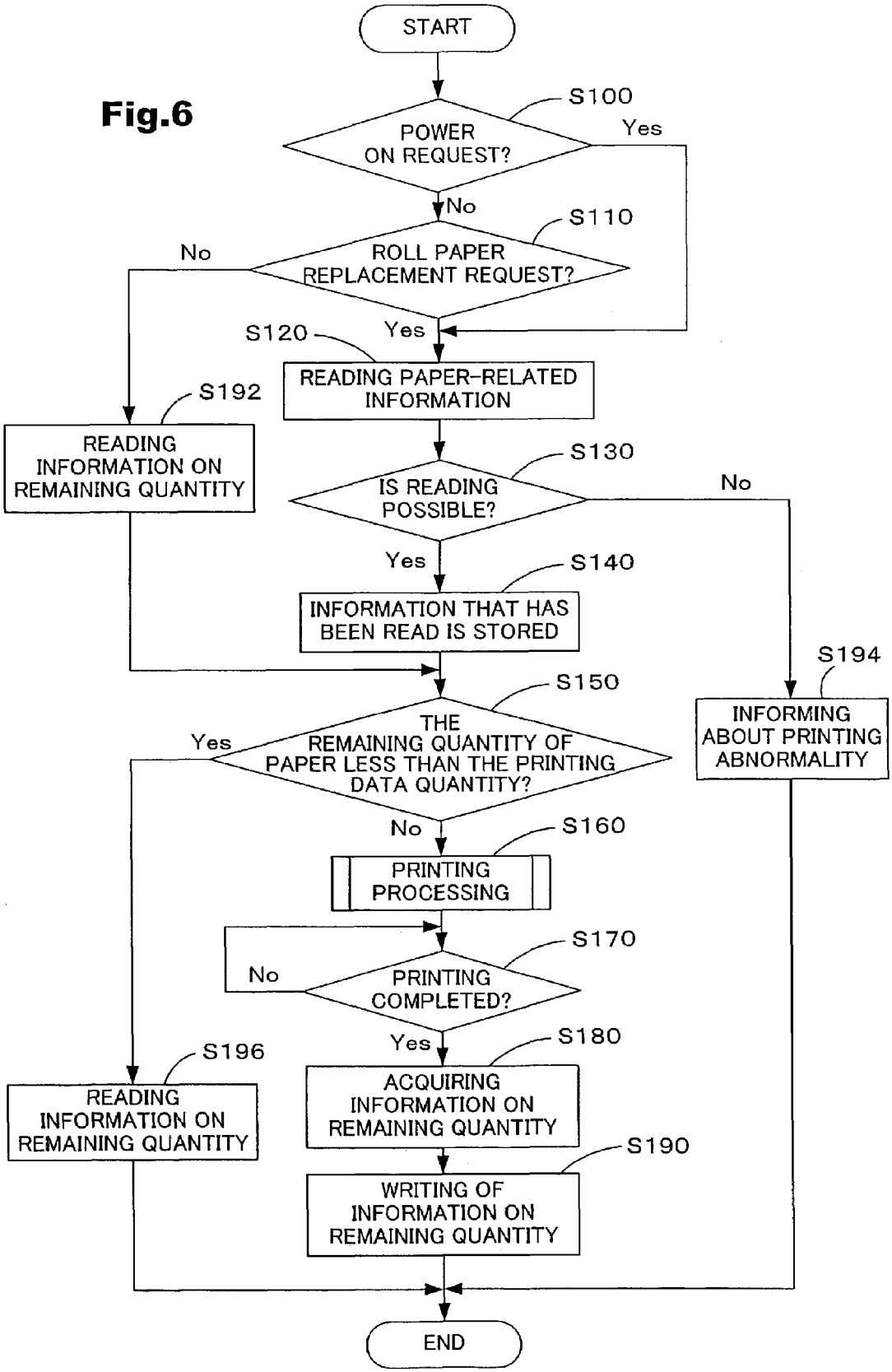
Fig.6
START
S100
POWER ON REQUEST?
Yes
No
S110
ROLL PAPER REPLACEMENT REQUEST?
No
Yes
S120
READING PAPER-RELATED INFORMATION
S192
READING INFORMATION ON REMAINING QUANTITY
S130
IS READING POSSIBLE?
No
Yes
S140
INFORMATION THAT HAS BEEN READ IS STORED
S194
INFORMING ABOUT PRINTING ABNORMALITY
S150
THE REMAINING QUANTITY OF PAPER LESS THAN THE PRINTING DATA QUANTITY?
Yes
No
S160
PRINTING PROCESSING
S170
PRINTING COMPLETED?
No
Yes
S180
ACQUIRING INFORMATION ON REMAINING QUANTITY
S196
READING INFORMATION ON REMAINING QUANTITY
S190
WRITING OF INFORMATION ON REMAINING QUANTITY
END

PRINTING DEVICE

TECHNOLOGY FIELD

The present invention relates to roll-shaped printing paper and a printing device for executing printing processing with respect to the roll-shaped printing paper.

BACKGROUND ART

A feed mode using cut paper that has been cut in advance to the prescribed size and a feed mode using roll paper obtained by winding paper for printing around a core are the main modes for feeding paper for printing in printing devices. The feed mode using roll paper is usually employed for feeding comparatively large paper requiring a large accommodation space, such as paper of A1 size, and the feed mode using cut paper is typically employed for feeding comparatively small paper, such as paper of A4 size.

By contrast with the cut paper for which the remaining quantity of paper can be easily visually determined, with roll paper, from which the paper is continuously fed to printing, the remaining quantity of paper is difficult to determine. Accordingly, a problem associated with the roll paper is that when the remaining quantity of paper in the roll cannot be accurately controlled, the paper of the roll runs out before the printing processing of the entire page is completed and printing cannot be completed. As an example of technology for controlling the remaining quantity of roll paper, Japanese Patent Application Laid-open No. 10-25046 disclosed a technology for storing the remaining quantity of roll paper for each roll paper in a memory provided in a separate roll paper control system.

However, the problem is that when the remaining quantity of roll paper is stored in a device such as printer or personal computer, the remaining quantity of roll paper cannot be controlled unless a device storing the remaining quantity of roll paper is used. Furthermore, if the remaining quantity of roll paper relating to a plurality of paper rolls is stored, or if the number of items that have to be stored, such as paper type, size, and the like, is increased, the required memory capacity is also increased. The problem is, however, that installing a large-capacity memory in the printer increases the cost.

Another problem is that the information on the remaining quantity of roll paper is used only to control the remaining quantity of roll paper and the information on the remaining quantity of roll paper cannot be utilized effectively.

DISCLOSURE OF THE INVENTION

The present invention was created to resolve the above-described problems, and it is an object of the present invention to store or detect paper-related information containing information on the remaining quantity of roll paper for printing, independently of the device. Another object of the present invention is to execute printing processing by using the stored or detected paper-related information.

In order to resolve the above-described problems, in accordance with the first aspect of the present invention, there is provided a printing device for printing to roll paper, which is provided with a memory device for rewritably storing information relating to the printing paper. The printing device in accordance with the first aspect of the present invention comprises a printing control device for controlling the paper feed quantity of the roll paper for printing by using the information relating to the printing paper which is stored in the memory device.

With the printing device in accordance with the first aspect of the present invention the paper feed quantity control of the roll paper for printing can be executed by using the information relating to the printing paper which is stored in the memory device. Therefore, the paper feed quantity control can be executed more appropriately.

In the printing device in accordance with the first aspect of the present invention, at least one of the remaining quantity of roll paper for printing and the type of roll paper for printing is stored as the information relating to the printing paper in the memory device, and the printing control device may control the paper feed quantity of the roll paper for printing according to at least any one of the remaining quantity of roll paper for printing and the type of roll paper for printing which are stored in the memory device.

With the printing device in accordance with the first aspect of the present invention, the paper feed quantity control is executed according to at least any one of the remaining quantity and type of roll paper for printing, which relate to the paper feed quantity control. Therefore, paper feed quantity control corresponding to the individual state of roll paper for printing can be executed.

In the printing device in accordance with the first aspect of the present invention, at least the remaining quantity of roll paper for printing is stored as the information relating to the printing paper in the memory device, and when the printing control device makes a decision that printing processing of the printing data quantity which has to be printed cannot be completed with the remaining quantity of roll paper for printing which is stored, based on the printing data quantity which has to be printed and the remaining quantity of roll paper for printing stored in the memory device, the printing control device interrupts the printing processing and informs to this effect. In such a case, it is possible to avoid a situation in which printing has to be interrupted because the paper has run out during printing. This is especially effective in printing to roll paper, in which the remaining quantity of paper is difficult to ascertain. In the printing device in accordance with the first aspect of the present invention, the printing device may further comprise an information input-output device for executing, in a non-contact mode, writing and reading of the information relating to roll paper for printing with respect to the memory device. In such a case, writing and reading of the information relating to roll paper for printing can be executed at any timing.

In the printing device in accordance with the first aspect of the present invention, the printing device may further comprise an information input-output device for executing in a contact mode, writing and reading of the information relating to roll paper for printing with respect to the memory device. In such a case, writing and reading of the information relating to roll paper for printing can be executed with higher reliability.

In accordance with the second aspect of the present invention, there is provided a printing device for executing printing with respect to a roll paper member provided with a memory device for rewritably storing paper-related information which relates to roll paper for printing. The printing device in accordance with the second aspect of the present invention comprises a holder unit for rotatably holding the roll paper member, a printing device antenna arranged in the holder unit so as to be able to transmit and receive signals with respect to the memory device at any timing, an information read-write unit for executing reading and writing of paper-related information with respect to the memory device via the printing device antenna, and a printing control unit for executing printing processing by using the paper-related information that has been read out.

With the printing device in accordance with the second aspect of the present invention, transmission and reception of signals with respect to the memory device of the roll paper member can be executed at any timing and printing processing can be executed by using the paper-related information which is stored in the memory device of the roll paper member. Therefore, the printing processing can be executed more appropriately.

The printing device in accordance with the second aspect of the present invention may have a configuration in which the roll paper member has hollow portions at least at both ends thereof, the holder unit comprises a rotary body rotating together with the roll paper member and having a mounting end which is mounted in the hollow portion of the roll paper member and a support end having a round outer peripheral shape, a roll paper antenna which is arranged along the outer periphery of the support end of the rotary body and connected to the memory device, and a support body which has a round inner peripheral shape and rotatably supports the support end of the rotary body, and the printing device antenna is arranged along the peripheral direction over almost the entire periphery of the support body.

With the printing device in accordance with the second aspect of the present invention, the roll paper member is held by the rotary body and support body. Therefore, the roll paper member can be held regardless of the shape thereof. Furthermore, because the rotary body is provided with the roll paper antenna connected to the memory device of the roll paper member and the printing device antenna is arranged in the support body along the peripheral direction over almost the entire periphery of the inner surface of the rotary body, the electric power necessary for the operation of the memory device of the roll paper member can be constantly obtained and the transmission and reception of signals can be executed at any timing.

The printing device in accordance with the second aspect of the present invention may have a configuration in which the roll paper member has hollow portions at least at both ends thereof, the holder unit comprises a rotary body rotating together with the roll paper member and having a mounting end which is mounted in the hollow portion of the roll paper member and a support end having a round inner peripheral shape, a roll paper antenna which is arranged along the inner periphery of the support end of the rotary body and connected to the memory device, and a support body which has a round outer peripheral shape and rotatably supports the support end of the rotary body, and the printing device antenna is arranged along the peripheral direction over almost the entire periphery of the support body.

With the printing device in accordance with the second aspect of the present invention, the roll paper member is held by the rotary body and the support body. Therefore, the roll paper member can be held regardless of the shape thereof. Furthermore, because the rotary body is provided with the roll paper antenna connected to the memory device of the roll paper member and the printing device antenna is arranged in the support body along the peripheral direction over almost the entire periphery of the outer surface of the rotary body, the electric power necessary for the operation of the memory device of the roll paper member can be constantly obtained and the transmission and reception of signals can be executed at any timing.

The printing device in accordance with the second aspect of the present invention may have a configuration in which the roll member body has hollow portions at least at both ends thereof, those hollow portions having a round inner peripheral surface and have arranged therein in the peripheral direction thereof a roll paper antenna connected to the memory device and transmitting and receiving radio signals, the holder unit has a support portion which rotatably supports the hollow portions of the roll paper member and has a cylindrical shape, and the printing device antenna is arranged along the peripheral direction over almost the entire inner peripheral surface or outer peripheral surface of the support body.

With the printing device in accordance with the second aspect of the present invention, the roll paper antenna connected to the memory device is provided in the hollow portion of the roll paper member and the printing device antenna is arranged in the support body along the peripheral direction over almost the entire inner peripheral surface or outer peripheral surface thereof. Therefore, the electric power necessary for the operation of the memory device of the roll paper member can be constantly obtained and the transmission and reception of signals can be executed at any timing.

The printing device in accordance with the second aspect of the present invention may have a configuration in which the roll paper member has hollow portions at least at both ends thereof, the holder unit comprises a rotary body mounted in the hollow portion of the roll paper member and rotating together with the roll paper member, a support body rotatably supporting the rotary body, and a roll paper antenna arranged in the rotary body in a position opposite the support body and connected to the memory device, wherein the printing device antenna has a surface area larger than that of the roll paper antenna and is arranged opposite the support body.

With the printing device in accordance with the second aspect of the present invention, the roll paper antenna is provided in the rotary body, which rotates together with the roll paper member, in a position opposite the support body, and the printing device antenna has a surface area larger than that of the roll paper antenna and is arranged opposite the support body in the holder unit. Therefore, the electric power necessary for the operation of the memory device of the roll paper member can be constantly obtained and the transmission and reception of signals can be executed at any timing.

With the third aspect of the present invention, there is provided a roll paper member. The roll paper member in accordance with the third aspect of the present invention comprises a roll paper for printing, a memory device for rewritably storing paper-related information which relates to the roll paper for printing, and a transmission-reception device for transmitting and receiving signals which is connected to the memory device.

With the roll paper member in accordance with the third aspect of the present invention, a memory device is provided for rewritably storing paper-related information which relates to the roll paper for printing. Therefore, the roll paper member can be used in a state correlated with the paper-related information, independently of the device which is being used.

In the roll paper member in accordance with the third aspect of the present invention, the transmission-reception device may be provided with an antenna for transmitting and receiving radio signals. In such a case, the paper-related information can be transmitted to and received from the printing device in a non-contact mode. Further, it is not necessary to consider a cover when arranging the antenna.

Therefore, the degree of freedom in arranging the transmission-reception device is increased.

The roll paper member in accordance with the third aspect of the present invention may further comprise a core having the roll paper for printing wound thereon, and the antenna may be arranged along the peripheral direction of the core, or it may further comprise a core having a hollow portion with the roll paper for printing wound thereon, and the antenna may be arranged along the peripheral direction of the outer peripheral surface or inner peripheral surface of the core. In such a case, the transmission and reception of paper-related information can be conducted at any timing and electric power sufficient for the operation of the transmission reception circuit can be generated via the antenna.

The roll paper member in accordance with the third aspect of the present invention may further comprise a core having the roll paper for printing wound thereon and comprising a flange portion covering the end surface of the roll paper for printing, and the antenna may be arranged in the flange portion of the core. In such a case, the transmission and reception of paper-related information can be conducted at any timing.

The roll paper member in accordance with the third aspect of the present invention may further comprise a housing body containing therein the roll paper for printing, wherein the memory device is provided in the housing body. In such a case, the above-described operation effect can be obtained even with respect to a roll paper member which is used while being housed in the housing body.

In the roll paper member in accordance with the third aspect of the present invention, the paper-related information may include at least any one information from the information on the remaining quantity of the roll paper for printing, production year, month, and date of the roll paper for printing, type of the roll paper for printing, and production lot of the roll paper for printing.

With the fourth aspect of the present invention, there is provided a printing method using a roll paper member provided with a memory device for rewritably storing paper-related information which relates to the roll paper for printing. The printing method in accordance with the fourth aspect of the present invention comprises the steps of: reading the paper-related information which is stored in the memory device and executing the printing processing by using the paper-related information that has been read out and controlling the paper feed quantity of the roll paper for printing.

With the printing method in accordance with the fourth aspect of the present invention, the operation effect can be obtained which is similar to that obtained with the printing device of the first aspect of the present invention. Furthermore, the printing method in accordance with the fourth aspect of the present invention can be implemented in a variety of embodiments, similarly to the printing device of the first aspect of the present invention.

With the fifth aspect of the present invention, there is provided a computer-readable recording medium for recording a printing control program using a roll paper member provided with a memory device for rewritably storing at least one of the remaining quantity of roll paper for printing and the type of roll paper for printing as the paper-related information which relates to the roll paper for printing. The printing control program stored in the computer-readable recording medium in accordance with the fifth aspect of the present invention, executes with the computer a function of reading the paper-related information that is stored in the memory device and a function of controlling the paper feed quantity of the roll paper for printing to execute the printing processing by using at least one of the remaining quantity of roll paper for printing and the type of roll paper for printing of the paper-related information and.

With the computer-readable recording medium in accordance with the fifth aspect of the present invention, the operation effect can be obtained which is similar to that obtained with the printing device of the first aspect of the present invention. Furthermore, the computer-readable recording medium in accordance with the fifth aspect of the present invention can be implemented in a variety of embodiments, similarly to the printing device of the first aspect of the present invention.

In accordance with the sixth aspect of the present invention, there is provided a roll paper printing system. The roll paper printing system in accordance with the sixth aspect of the present invention comprises a roll paper for printing, a roll paper member comprising detection means for detecting the remaining quantity of the roll paper for printing, and a printing device provided with printing control means for executing the printing processing by taking account of the remaining quantity of paper that has been detected.

With the roll paper printing system in accordance with the sixth aspect of the present invention, printing processing corresponding to the remaining quantity of roll paper for printing can be executed.

BRIEF DESCRIPTION OF THE DRAWINGS

FIG. 6 is a flow chart illustrating the printing processing which is executed in the color printer CP during printing and includes data transmission and reception executed between the control circuit 50 and IC memory module 33;

DESCRIPTION OF THE PREFERRED EMBODIMENT

The roll paper printing system in accordance with the present invention will be described in the below-described order based on embodiments thereof with reference to the appended drawings.

A. Example of configuration of the roll paper printing system of the first embodiment.

B. Operation of the roll paper printing system of the first embodiment

C. Example of configuration of the roll paper printing system of the second embodiment.

D. Example of configuration of the roll paper printing system of the third embodiment.

E. Other embodiments of roll paper member.

F. Other embodiments.

Figure 1:
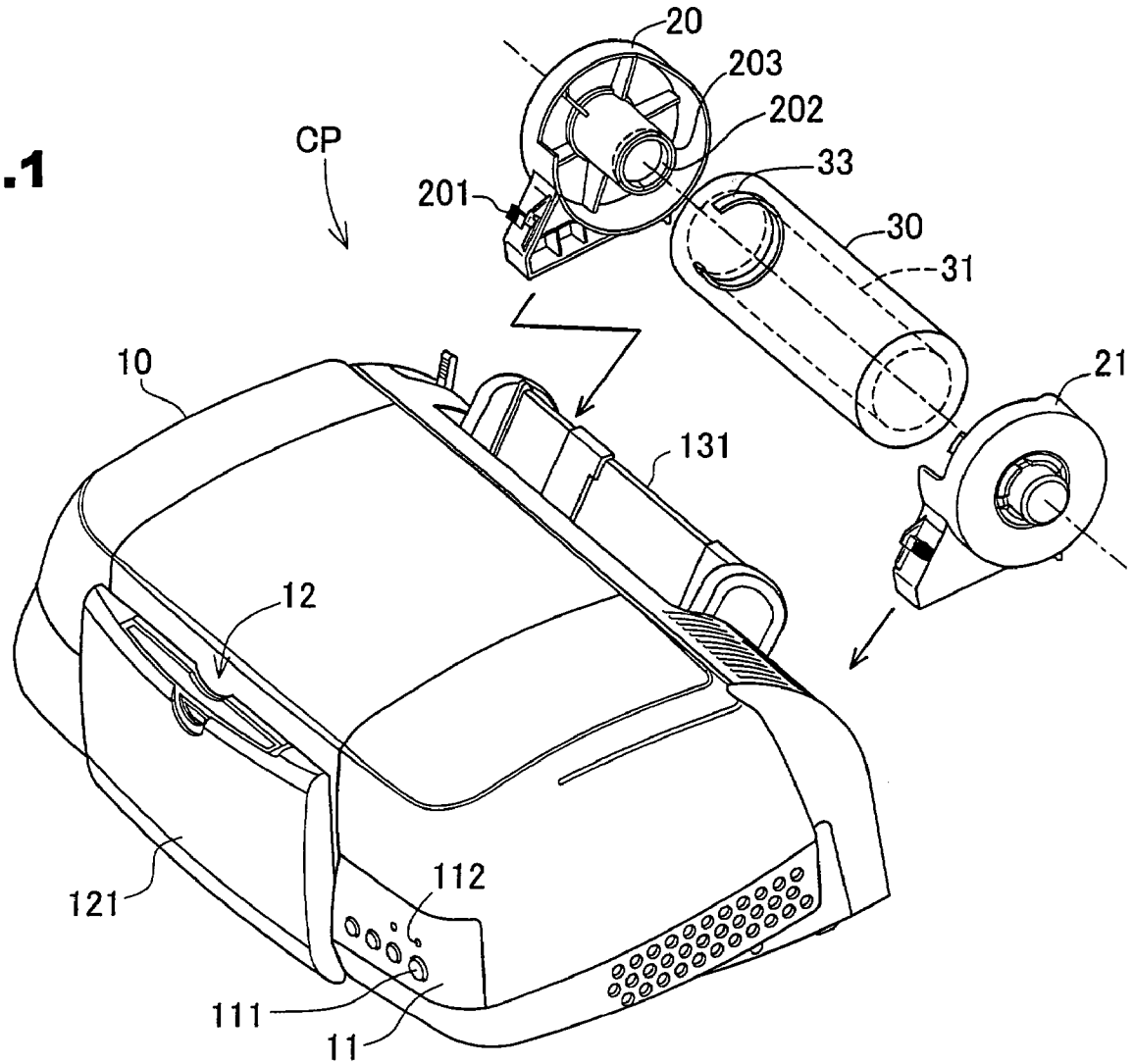
FIG. 1 is a schematic view illustrating the external configuration of the printing system for roll paper of the first embodiment.

A. Example of Configuration of the Roll Paper Printing System of the First Embodiment The external configuration of the roll paper printing system of the first embodiment will be described below with reference to FIG. 1. FIG. 1 is a schematic drawing illustrating the external configuration of the roll paper printing system of the first embodiment.

In the first embodiment, a color printer CP is employed as a printing device constituting the roll paper printing system. The color printer CP is a printer capable of outputting color images, for example, an ink-jet printer forming images by ejecting color inks of four colors: cyan (C), magenta (M), yellow (Y), and black (K), on a printing medium such as roll paper and forming a dot pattern. In addition to the above-mentioned four colors of color inks, light cyan (LC), light magenta (LM), and dark yellow (DY) may be used.

As shown in FIG. 1, the color printer CP has a structure in which printing paper fed from the rear surface is discharged from the front surface. A control panel 11 and a paper discharge unit 12 are provided on the front surface of a printer body 10, and a paper feed unit 13 is provided on the rear surface. Control buttons 111 and display lamp 112 are arranged on the control panel 11. The paper discharge unit 12 is provided with a paper discharge tray 121 which closes a paper discharge opening when the unit is not used. The paper feed unit 13 is provided with a paper feed holder 131 for holding a cut paper (not shown in the figure) for paper feeding and roll paper member holders 20, 21 for holding the roll paper member 30 for paper feeding.

The roll paper member 30 comprises a core 31, a roll paper 32 for printing which is wound around the core 31, and an IC memory module 33 arranged over ¾ in the peripheral direction of the internal peripheral surface of core 31. The IC memory module 33 is a non-contact thin-sheet circuit module comprising a memory antenna 331 for radio signal transmission and reception and a memory 332 comprising a region where a stored data can be freely rewritten and a region where a stored data cannot be freely rewritten. The IC memory 332 stores various types of information relating to the roll paper for printing, such as information on the remaining quantity, type, production lot number, and production year, month, and data of roll paper for printing. Among those examples of types of information, the information on the remaining quantity of roll paper for printing is the information that can be rewritten at the prescribed timing and is stored in the region that can be freely rewritten. Other information is the information which is written during shipping from the production plant and cannot be rewritten; this information is stored in the region that cannot be freely rewritten.

The roll paper member holders 20, 21 are arranged so as to form a pair on both sides of the rear surface of printer body 10. One of the roll paper member holders, in the present embodiment the roll paper member holder 20, comprises an electric contact 201 with the printer body 10, and a transmission-reception antenna 202 for receiving data from the IC memory module 33 (memory antenna 331) of roll paper member 30. In FIG. 1, the roll paper member holders 20, 21 are shown in a state in which they have been detached from the printer body 10 and roll paper member 30 in order to illustrate the contact 201 and transmission-reception antenna 202 provided in the roll paper member holder 20.

Figure 2:
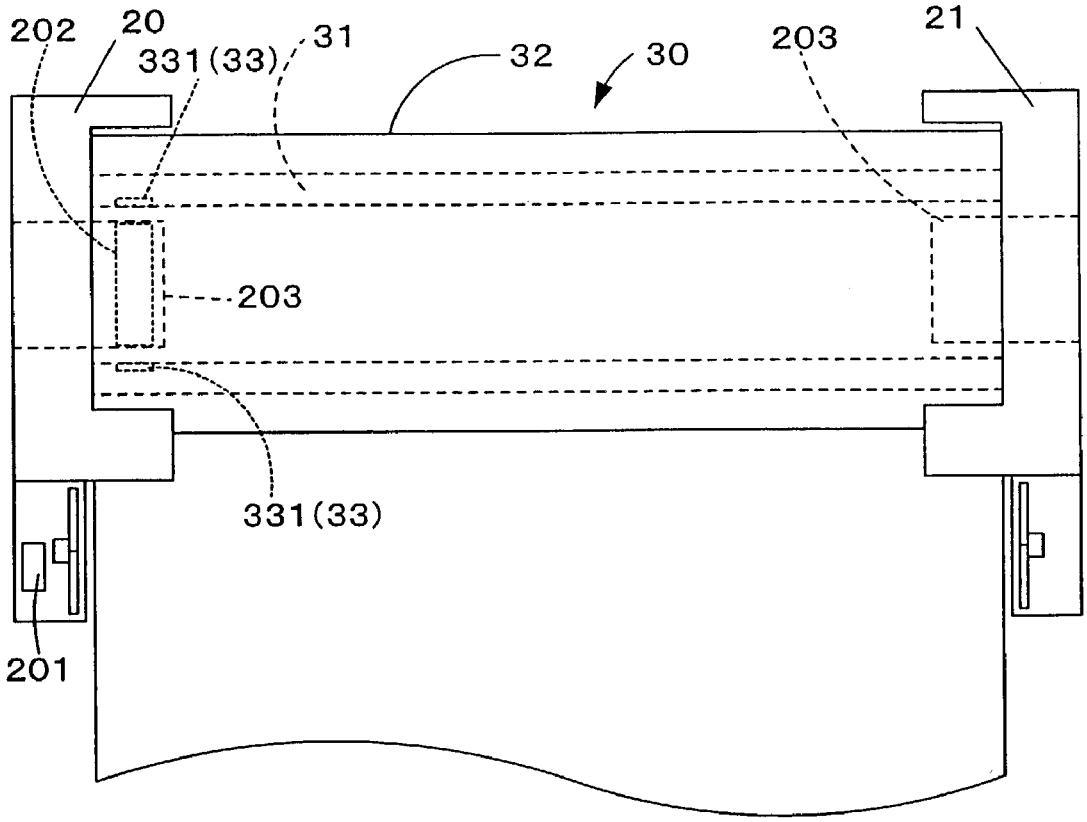
FIG. 2 illustrates the relative positions of transmission-reception antenna 202 and IC memory module 33 in a state in which the roll paper member 30 is held by the roll paper member holders 20, 21.
Figure 3:
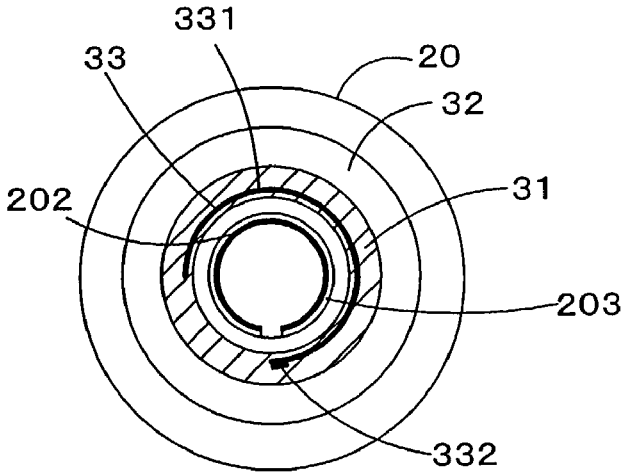
FIG. 3 is a side view in which the configuration shown in FIG. 2 is viewed from the side of roll paper member holder 20.

The relative positions of the memory antenna 331 of roll paper member 30 and transmission-reception antenna 202 of roll paper member holder 20 will be explained with reference to FIG. 2 and FIG. 3. FIG. 2 illustrates the relative positions of memory antenna 331 in a state in which the roll paper member 30 is held by the roll paper member holders 20, 21, and the transmission-reception antenna 202. FIG. 3 is a side view in which the configuration shown in FIG. 2 is viewed from the side of roll paper member holder 20.

In the present embodiment, the non-contact IC memory module is used as the IC memory module 33 and no contact is required for data transmission and reception. Therefore, as shown in FIG. 2 and FIG. 3, the transmission-reception antenna 202 is arranged along the peripheral direction over almost the entire inner peripheral surface of a cylindrical roll paper holding member 203 provided in the roll paper member holder 20. Further, as described above, the memory antenna 331 is arranged over 34 in the peripheral direction of the internal peripheral surface of core 31 of roll paper member 30. The non-contact IC memory module 33 generates the necessary electric power by using magnetic field formed by an external transmission-reception circuit (transmission-reception antenna 202). In the present embodiment, because the transmission-reception antenna 202 of roll paper holder 20 is longer than the memory antenna 331 of roll paper member 30, the transmission-reception antenna 202 is in the nearest-neighbor relationship with the memory antenna 331 and can conduct transmission and reception of signals at any timing. When an IC memory module of a close proximity type with a transmission-reception distance of about 2 mm is used as the IC memory module 33, data transmission and reception are executed at a timing of the nearest-neighbor relationship of the IC memory module 33 and transmission-reception antenna 202. Further, when an IC memory module of a proximity type with a transmission-reception distance of about 20 cm is used, data transmission and reception can be executed regardless of the relative position of IC memory module 33 and transmission-reception antenna 202. It goes without saying that a contact-type IC memory can be used as the IC memory module 33. In such a case, a contact is used instead of the transmission-reception antenna 202 in the roll paper member holder 20, and data transmission and reception is executed when the roll paper member 30 rotates and the contact of roll paper member holder 20 comes in touch with the contact of IC memory module.

Figure 4:
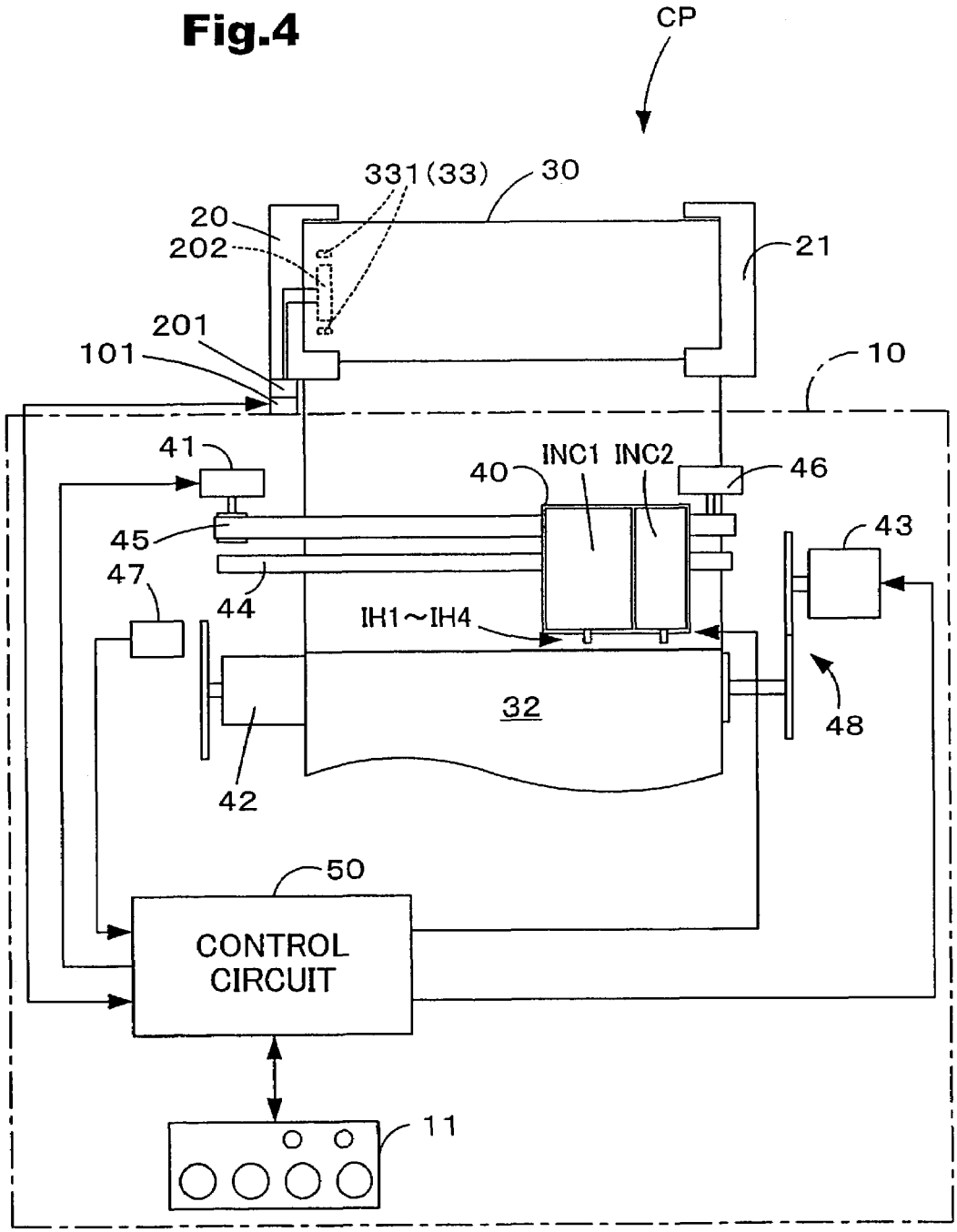
FIG. 4 illustrates schematically the internal configuration of printing system for roll paper of the first embodiment.

The internal configuration of color printer CP will be described below with reference to FIG. 4. FIG. 4 illustrates schematically the internal configuration of the roll paper printing system of the first embodiment. The color printer CP, as shown in the figure, is composed of a mechanism for conducting ejection of inks and dot formation by driving a printing head 40 mounted on a carriage 40, a mechanism for causing reciprocal movement of carriage 40 in the axial direction of a platen 42 with a carriage motor 41, a mechanism for transporting the roll paper 32 for printing, which is supplied from the roll paper member 30 by a paper feed motor 43, and a control circuit 50. The mechanism for causing reciprocal movement of carriage 40 in the axial direction of platen 42 is composed of a sliding shaft 44 slidably supporting the carriage 40 installed parallel to the shaft of platen 42, and a pulley 46, with an endless drive belt 45 being stretched over the pulley and the carriage motor 41.

The mechanism for transporting the roll paper 32 for printing, which is supplied from the roll paper member 30, is composed of the platen 42, a paper feed motor 43 for rotating the platen 42, an auxiliary roller for paper feed (not shown in the figure), and a gear mechanism 48 for transferring the rotation of paper feed motor 43 to an encoder 47 for detecting the rotation angle of platen 42 and the auxiliary roller for paper feed. The transmission-reception antenna 202 arranged on the roll paper holding member 203 of roll paper member holder 20 is connected by a wire to the contact 201 arranged on the base portion of roll paper member 20. The contact 101 of the printer body 10 is arranged opposite the contact 201.

A control circuit 50 appropriately controls the movement of paper feed motor 43, carriage motor 41, and printing head 401, while exchanging signals with the control panel 11 of the printer. The roll paper 32 for printing of the roll paper member 30 held by the roll paper member holders 20, 21 of the color printer CP is set so as to be sandwiched between the platen 42 and auxiliary roller for paper feed and is fed in the prescribed quantity according to the rotation angle of platen 42.

An ink cartridge INC1 and ink cartridge INC 2 are mounted on the carriage 40. Memory elements ME that store the remaining quantity of ink are provided in the ink cartridges INC1, INC 2. Black (K) ink is contained in the ink cartridge INC1 and other inks, that is, inks of three colors, cyan (C), magenta (M), and yellow (Y), are contained in the ink cartridge INC2. As described above, light cyan (LC), light magenta (LM), and dark yellow (DY) inks also can be contained.

Figure 5:
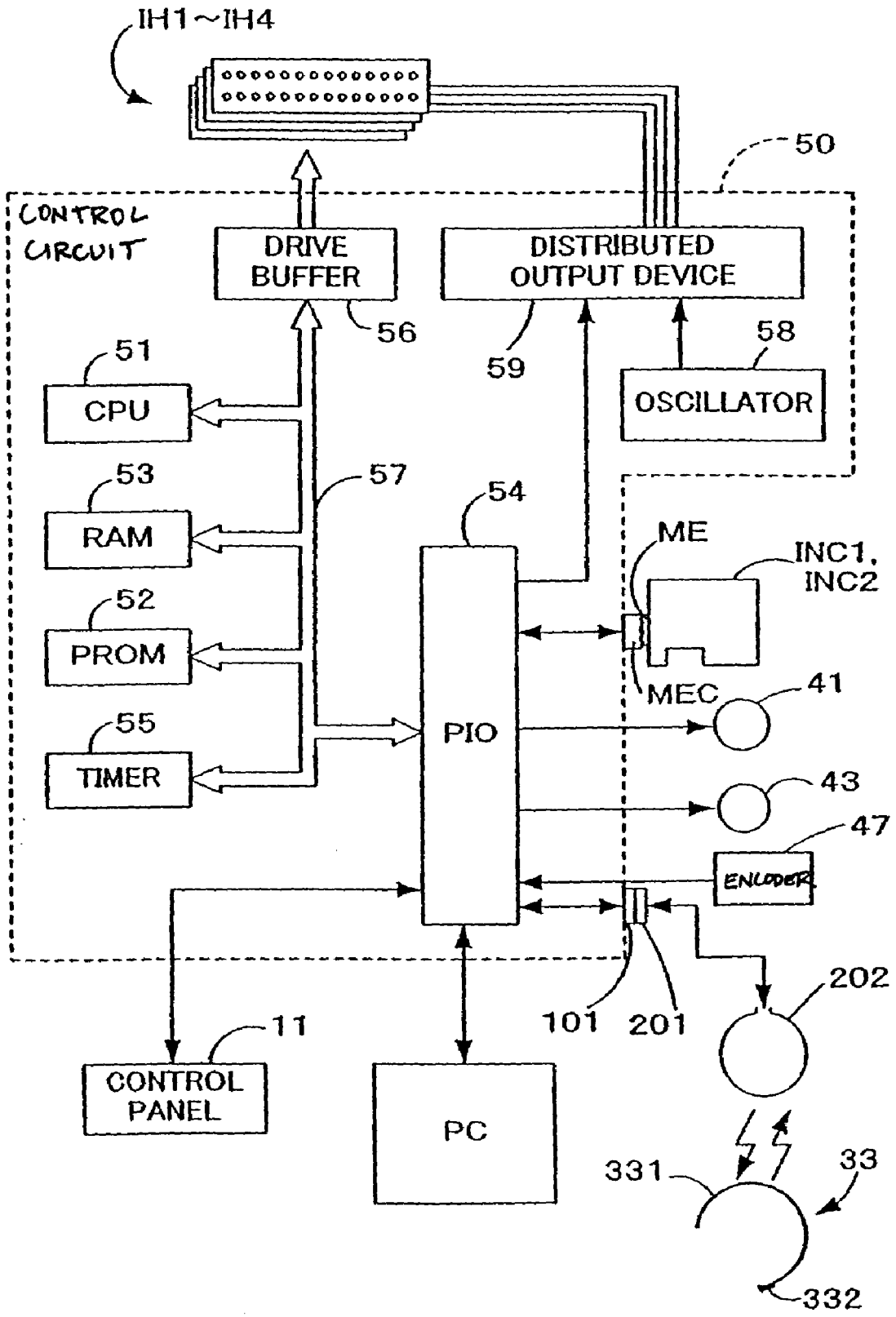
FIG. 5 is a block diagram illustrating the internal configuration of control circuit of the printing system for roll paper of the first embodiment.

The internal configuration of control circuit 50 of color printer CP will be described below with reference to FIG. 5. FIG. 5 is a block diagram illustrating the internal configuration of control circuit of the roll paper printing system of the first embodiment. As shown in the figure, a CPU 51, a PROM 52, a RAM 53, a peripheral input-output unit (PIO) 54, a timer 55, and a drive buffer 56 are provided inside the control circuit 50. A personal computer PC, a contact MEC of memory elements ME of ink cartridges, the carriage motor 41, the paper feed motor 43, the encoder 47, and the transmission-reception antenna 202 (via the contacts 101 and 201) are connected to the PIO 54. The drive buffer 56 is used as a buffer for supplying on-off signals of dot formation to heads IH1 to IH4 for ink ejection. The above-mentioned components are connected to each other with a bus 57 allowing for mutual exchange of data. Further, an oscillator 58 for outputting a drive waveform at the prescribed frequency, and a distributed output device 59 for distributing the output from the oscillator 58 to the heads IH1 to IH4 for ink ejection with the prescribed timing are also provided in the control circuit 50.

The control circuit 50 accesses the memory 332 arranged in the core 31 of roll paper member 30 via the transmission-reception antenna 202, for example, when the power source is turned on and during replacement of roll paper member 30 and power supply interruption. The control circuit 50 controls the printing processing by taking account of the information acquired from the memory 332. The control circuit 50 outputs dot data to the drive buffer 56 at the prescribed timing, while operating in synchronism with the movement of paper feed motor 43 or operating in synchronism with the movement of paper feed motor 43 or carriage motor 42. Access to IC memory module 33 (memory 332) and printing using the information acquired from the IC memory module 33 (memory 332) will be described below in greater detail.

B. Operation of the Roll Paper Printing System of the First Embodiment

Figure 7:
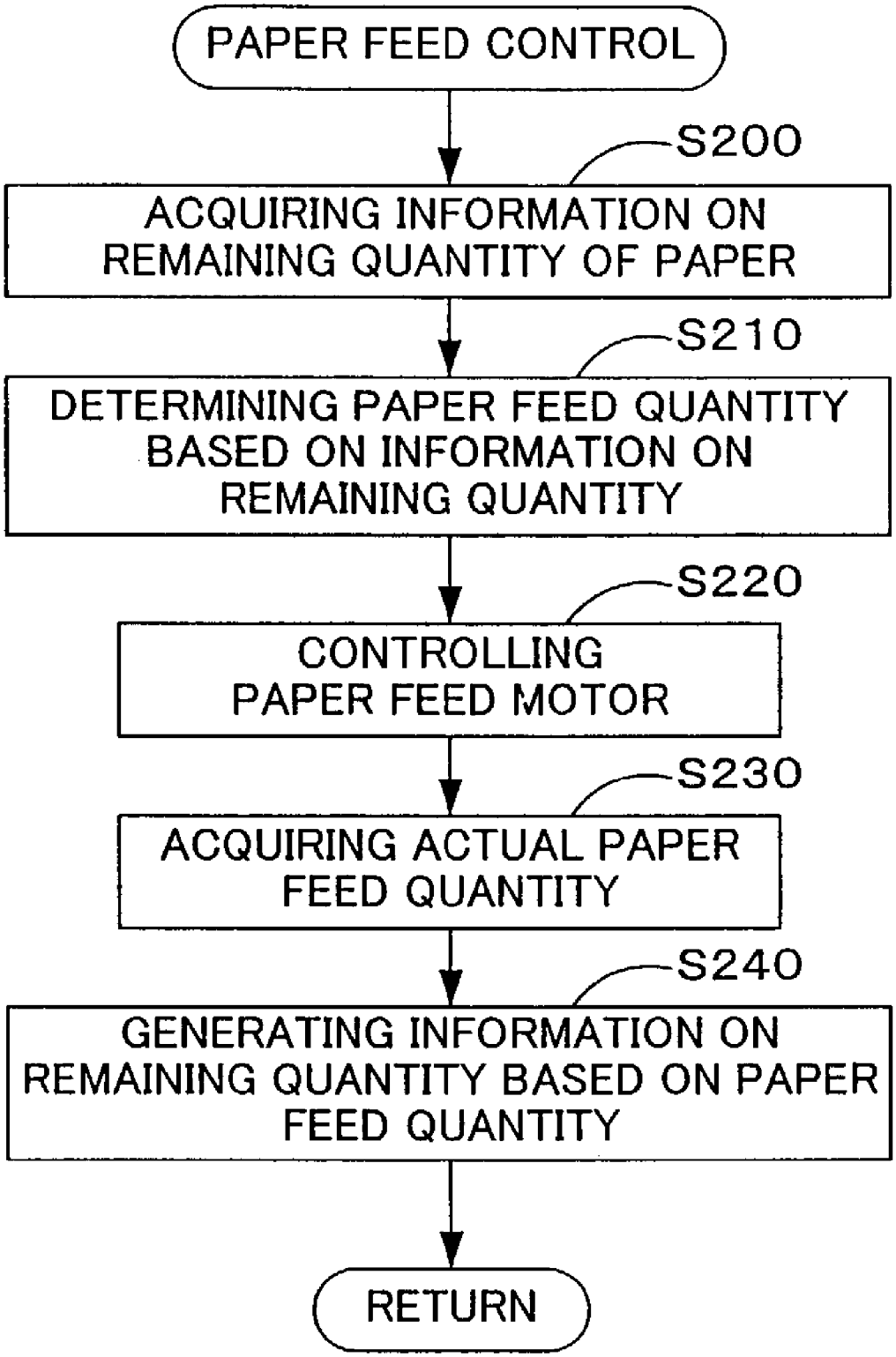
FIG. 7 is a flow chart illustrating the back tension control processing executed by taking account of the remaining quantity of paper for printing that was acquired from the IC memory module 33.

The operation of the roll paper printing system of the first embodiment will be described by using the color printer CP with reference to FIG. 6 and FIG. 7. FIG. 6 is a flow chart illustrating the printing processing which is executed in the color printer CP during printing and includes data transmission and reception executed between the control circuit 50 and IC memory module 33. FIG. 7 is a flow chart illustrating the back tension control processing executed by taking account of the remaining quantity of paper for printing that was acquired from the IC memory module 33.

The control circuit 50 makes a decision as to whether of not the power ON request has been sent (step S100). Thus, a decision is made as to whether or not this is the operation start period of color printer CP. If the control circuit 50 makes a decision that power ON request has not been sent, it concludes that the color printer CP is in the operation mode and makes a decision as to whether or not the request to replace the roll paper member 30 has been sent (step S110). The request to replace the roll paper member 30 is sent, for example, when the roll paper replacement button 111 on the control panel 11 is pushed down.

If the control circuit 50 makes a decision that the request to replace the roll paper member 30 has been sent (step S110: Yes), it accesses the memory 332 provided in the core 31 of roll paper member 30 via the transmission-reception antenna 202 and memory antenna 331 and executes reading of paper-related information (step S120). When the control circuit 50 makes a decision that the power ON request has been sent (step S100: Yes), reading of the paper-related information from memory 332 is also executed (step S120).

When the control circuit 50 can read the paper-related information from the memory 332 (step S130: Yes), the read-out paper-related information is temporarily stored in the RAM 53 (step S140). The control circuit 50 acquires the information on the remaining quantity of paper from the paper-related information that has been stored and makes a decision as to whether or not the printing data quantity is larger than the remaining quantity of paper (step S150). Thus, the quantity of paper necessary for printing the requested printing data quantity is compared with the remaining quantity of paper.

When the control circuit 50 makes a decision that the remaining quantity of paper is no less than the printing data quantity (step S150: No), the printing processing is executed (step S160). The printing processing is executed by the above-described or conventional processing. The control of paper feed motor 43 executed during printing processing will be described below with reference to FIG. 7.

Control circuit 50 acquires the information on the remaining quantity of paper from the RAM 53 (step S200) and determines the paper feed quantity, that is, the drive electric current supplied to the paper feed motor 43, based on the acquired information on the remaining quantity of paper (step S210). For example, when the remaining quantity of roll paper member 30 (roll paper 32 for printing) is large, the force unwinding the roll paper member 30, that is, the back tension, is high. Therefore, a paper feed greater than the requested paper feed quantity is executed. When the drive electric current is determined, a reference table may be provided for determining the drive electric current from the remaining quantity of paper, or the drive electric current may be calculated from the remaining quantity of paper by using the relationship between the remaining quantity of paper and drive electric current. Furthermore, information relating to paper type may be read instead of or together with the information on the remaining quantity of paper, and the paper feed quantity may be further increased in the case of paper with good sliding properties.

The control circuit 50 supplies the drive electric current to the paper feed motor 43 and causes the rotation of the paper feed motor 43 through a rotation angle corresponding to the paper feed quantity that has been determined (step S220). The control circuit 50 acquires the actual rotation angle from the encoder 47 (step S230), generates the information on the remaining quantity of paper based on the paper feed quantity that has been acquired (step 240), stores it in the RAM 53 and returns to the flow chart shown in FIG. 6.

The explanation will be again continued with reference to FIG. 6. If the control circuit 50 waits for the end of printing (step S170: No) and decides that the printing has been ended (step S170: Yes), it acquires the information on the remaining quantity of paper from the RAM53 (step S180). The control circuit 50 accesses the IC memory module 33 of roll paper member 30 via the transmission-reception antenna 202 and memory antenna 331, writes the information on the remaining quantity of paper into the memory 332 (step S190), and ends the present processing routine.

Further, if the control circuit 50 decides in step S110 that the request to replace the roll paper member 30 has not been sent (step S110: No), it reads the renewed information on the remaining quantity of paper from the memory 332 (step S192), and executes the processing of step S150. Furthermore, if the control circuit decides in step S130 that the paper-related information cannot be read from the memory 332 (step S130: No), it informs about the appearance of reading abnormality via a graphical user interface (GUI) displayed on the display of computer PC or via the display lamp 112 on the control panel 11 (step S194) and ends the present processing routine.

Furthermore, when the requested printing data quantity in step S150 is larger than the remaining quantity of paper (step S150: Yes), the control panel 50 informs via the GUI or display lamp 112 on the control panel 11 that printing cannot be completed correctly (step S196), and ends the present processing routine.

As described above, with the roll paper printing system of the first embodiment, because the roll paper member 30 is provided with the IC memory module 33 which stores the paper-related information, printing processing reflecting the paper-related information can be executed during printing. When the information on the remaining quantity of paper is used as the paper-related information, the paper feed motor 43 is controlled according to the remaining quantity of paper and the paper feed quantity of roll paper 32 for printing is adjusted, thereby making it possible to execute the requested paper feed quantity even if the back tension is generated. Furthermore, the requested printing data quantity is compared with the remaining quantity of paper prior to printing processing, and when the printing data quantity is larger than the remaining quantity of paper, the printing processing is interrupted to prevent paper from rupture during printing.

Further, since paper-related information is stored in the roll paper member 30, the advantage is that one roll paper can be used at the same time in a plurality of color printers CP and that no other device is required to control the remaining quantity of roll paper. Moreover, since the paper-related information is controlled in roll paper member 30 units, the necessary memory resources can be reduced and the cost of the roll paper printing system can be decreased by comparison with the case of centralized control.

Further, because the IC memory module 33 is rewritable, the used core 31 can be recovered, the roll paper 32 for printing can be again wound thereon, and various information relating to the roll paper for printing, such as information on the remaining quantity, type, production lot number, and production year, month, and data of roll paper for printing can be rewritten. Therefore, the core 31 can be effectively recycled.

Figure 8:
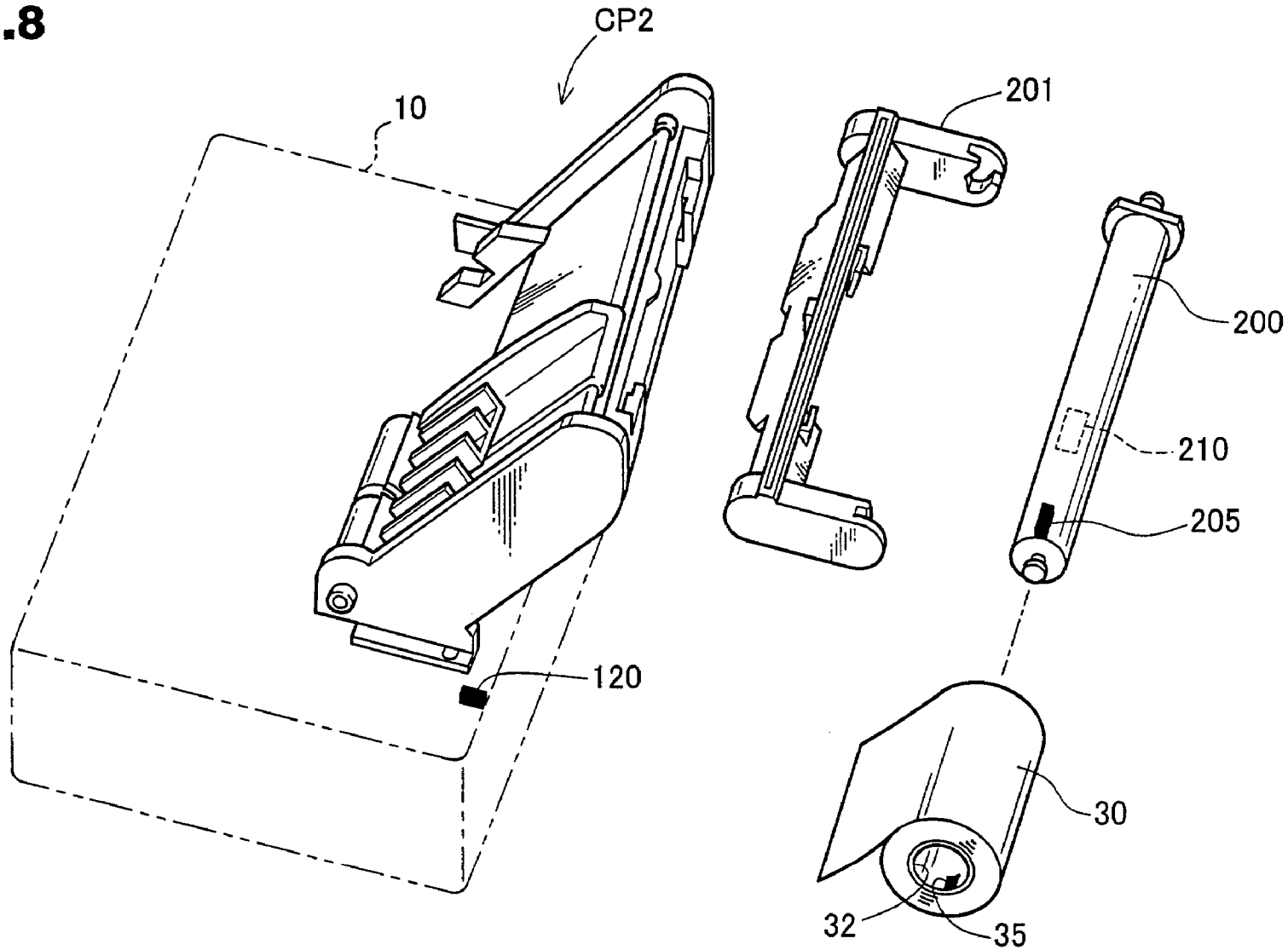
FIG. 8 illustrates the external configuration of the roll paper printing system of the second aspect.

C. Example of the Configuration of the Roll Paper Printing System of the Second Embodiment An example of the configuration of the roll paper printing system of the second embodiment will be described with reference to FIG. 8. FIG. 8 illustrates the external configuration of the roll paper printing system of the second aspect. Among the structural elements of the roll paper printing system of the second aspect, those structural elements that are identical to the structural elements of the roll paper printing system of the first embodiment are assigned with the same reference symbols and the explanation thereof is omitted.

In the roll paper printing system of the second aspect, a color printer CP2 is used as the printing device. In the color printer CP2, the roll paper member 30 is held with respect to the printer body with a roll paper support shaft 200 and a roll paper member holder 201 rotatably holding the roll paper support shaft 200.

A contact-type memory element 35 is provided in the core 32 of roll paper member 30, and a contact 205 corresponding to the memory element 35 is provided in the roll paper support shaft 200. For example, an EEPROM can be used as the memory element 35. A transmission-reception circuit 210 and a power source (not shown in the figures) are enclosed inside the shaft of roll paper support shaft 200. The transmission-reception circuit 210 executes writing of paper-related information to the memory element 35 and reading the information therefrom, transmits the paper-related information that has been read out to the printer body 10, and receives the writing information from the printer body 10. In the printer body 10, there is provided a transmission-reception circuit 120 for transmitting radio signals to the transmission-reception circuit 210 located inside the roll paper support shaft 23 and receiving radio signals therefrom.

In the present embodiment, the transmission-reception circuit 210 reads from the memory element 35 and writes thereinto every time the roll paper member 30 rotates and the contact 205 of roll paper support shaft 200 is brought into contact with the memory element 35 of roll paper member 30. The transmission-reception circuit 210 transmits the paper-related information that has been read from the memory element 35 to the printer body 10 or receives the paper-related information which is to be written from the printer body, in response to a request from the transmission-reception circuit 120 of printer body 10.

With the roll paper printing system of the second embodiment, the effect similar to that of the roll paper printing system of the first embodiment can be obtained.

Figure 9:
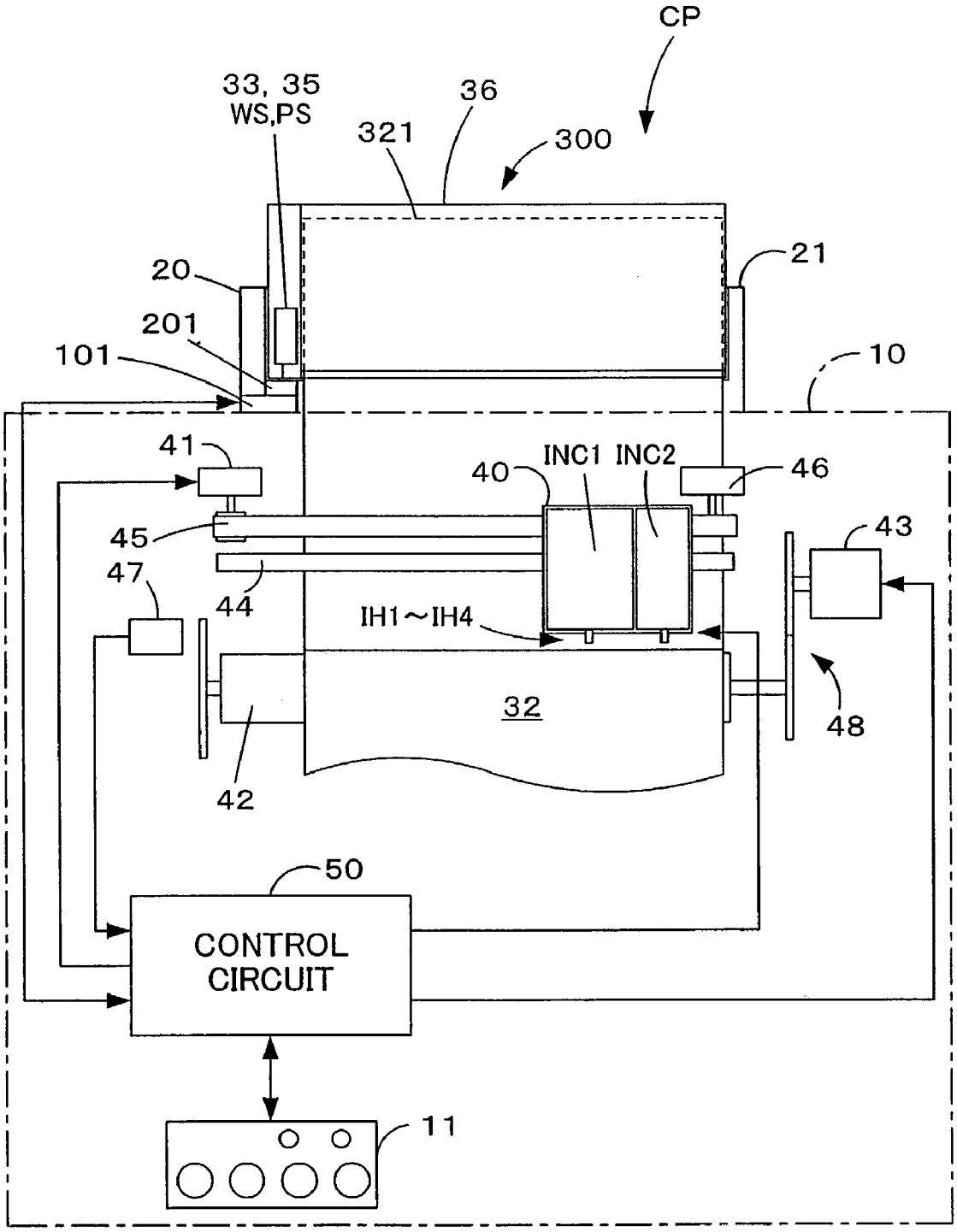
FIG. 9 illustrates the schematic configuration of the roll paper printing system of the third embodiment.
Figure 10:
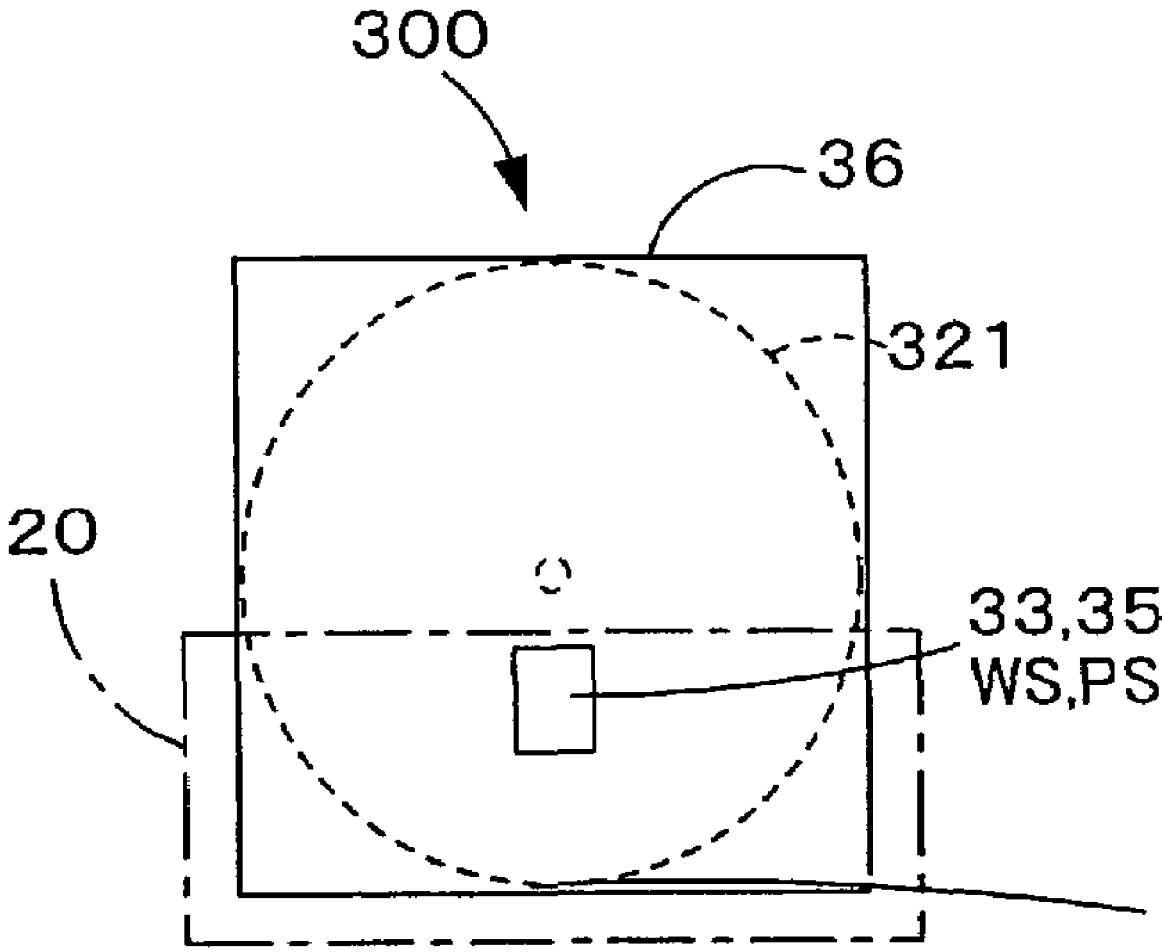
FIG. 10 is a side view of roll paper member used in the roll paper printing system of the third embodiment.

D. Example of the Configuration of the Roll Paper Printing System of the Third Embodiment An example of the configuration of the roll paper printing system of the third embodiment will be described with reference to FIGS. 9 and 10. FIG. 9 illustrates the schematic configuration of the roll paper printing system of the third aspect. FIG. 10 is a side view of roll paper member used in the roll paper printing system of the third embodiment. Among the structural elements of the roll paper printing system of the third aspect, those structural elements that are identical to the structural elements of the roll paper printing system of the first embodiment are assigned with the same reference symbols and the explanation thereof is omitted.

In the first and second embodiments, the roll paper member 30 was used in which the roll paper 32 for printing was wound around the core 31. However, in the third embodiment, as shown in FIG. 9 and FIG. 10, a roll paper member 300 is used in which a roll paper 321 for printing having no core 31 is enclosed in the case 36. When such a configuration is provided, the roll paper 321 for printing is supported by the inner wall of case 36, and the memory device such as the IC memory module 33 and memory element 35 is provided in the case 36.

The advantage of such a configuration is that because the roll paper 321 for printing is supported by the inner wall of case 36, when the roll paper 321 for printing is fed, the roll paper 321 for printing cannot be fed obliquely with respect to the platen 42. Furthermore, when the roll paper 321 for printing is consumed it is replaced together with the case 36.

With the roll paper printing system of the third embodiment, in addition to the above-described advantages, the effect similar to that of the roll paper printing system of the first embodiment can be obtained.

E. Other Embodiments of the Roll Paper Member Holders 20, 21

Figure 11:
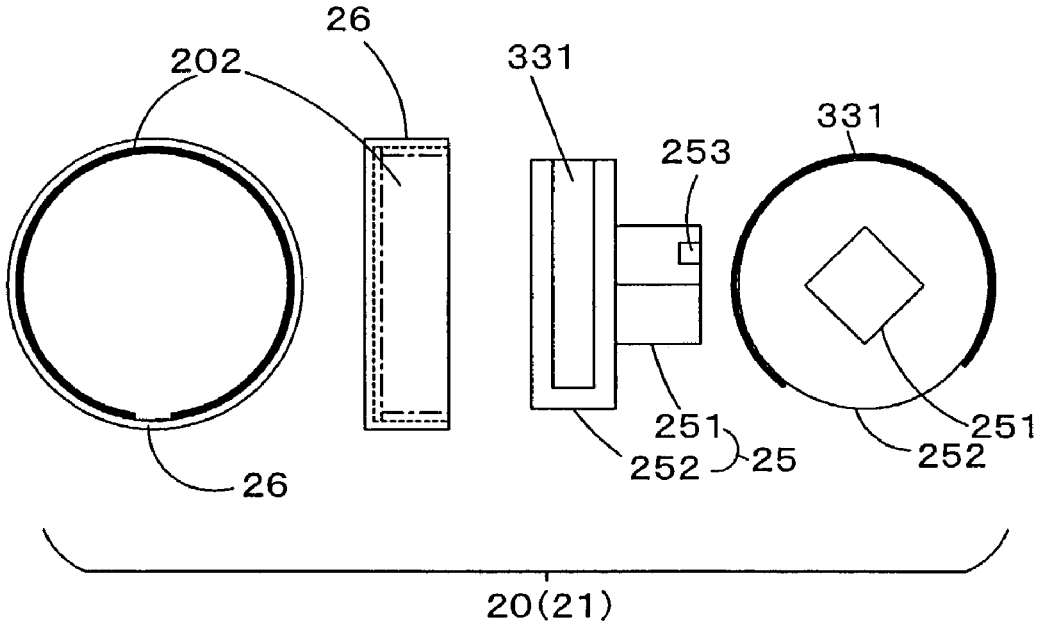
FIG. 11 illustrates an example of another embodiment of the roll paper member holders 20, 21.
Figure 12:
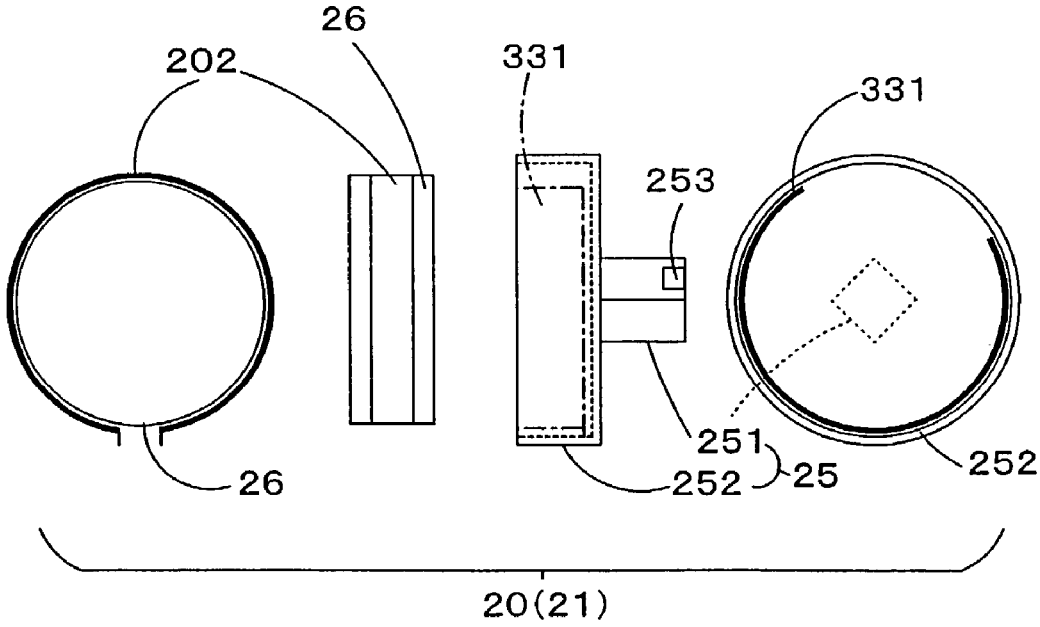
FIG. 12 illustrates an example of another embodiment of the roll paper member holders 20, 21.

Other embodiments of the roll paper member holders 20, 21 will be described below with reference to FIG. 11 and FIG. 12. FIG. 11 illustrates an example of another embodiment of the roll paper member holders 20, 21. FIG. 12 illustrates an example of another embodiment of the roll paper member holders 20, 21. The below-described configuration may be provided with any one of the roll paper member holders 20, 21. Therefore, the explanation below will be conducted by taking the roll paper member holder 20 as an example.

In the example shown in FIG. 11, the roll paper member holder 20 comprises a rotary body 25 mounted on the roll paper member 30 and rotating together with the roll paper member 30 and a support body 26 holding the rotary body 25 so that it is free to rotate. In FIG. 11, a front view and a side view of rotary body 25 and a front view and a side view of support body 26 are presented. Of the end portions of rotary body 25, the mounting end 251 which is mounted on the hollow part of roll paper member 30 has, for example, a square columnar shape, and the support end 252 supported by the support body 26 has a round columnar shape. On the mounting end 251, there is provided a connection portion 253 for forming an electric connection with a memory (not shown in the figure) mounted on the roll paper member 30. A memory antenna 331 is arranged along the peripheral direction on the outer periphery of support end 252. An IC memory module is composed of the memory mounted on the roll paper member 30 and the memory antenna 331.

The support body 26 has a cylindrical shape having one side thereof closed with a lid. The transmission-reception antenna 202 is arranged inside the cylindrical portion along the peripheral direction over almost the entire perimeter thereof.

In the example shown in FIG. 12, of the end portions of rotary body 25, the mounting end 251 which is mounted on the hollow part of roll paper member 30 has, for example, a square columnar shape, and the support end 252 supported by the support body 26 has a cylindrical shape. In FIG. 12, too, a front view and a side view of rotary body 25 and a front view and a side view of support body 26 are presented. On the mounting end 251, there is provided a connection portion 253 for forming an electric connection with a memory (not shown in the figure) mounted on the roll paper member 30. A memory antenna 331 is arranged along the peripheral direction on the inner periphery of support end 252. An IC memory module is composed of the memory mounted on the roll paper member 30 and the memory antenna 331.

The support body 26 has a cylindrical shape or a round columnar shape, and the transmission-reception antenna 202 is arranged along the peripheral direction over almost the entire perimeter on the outer side of the cylindrical or round columnar portion.

With the above-described two embodiments, the roll paper member 30 is contained in the roll paper member holder 20 and the printing processing can be executed, regardless of the shape of the hollow portion of core 31 of roll paper member 30. Furthermore, the roll paper member 30 may be provided with a memory and it is not necessary to provide the memory antenna 331. Therefore, the cost of roll paper member 30 can be reduced and the memory arrangement position can be freely determined without considering relative positions of the memory and transmission-reception antenna 202.

Further, the memory antenna 331 may be arranged in a position (plane) opposite the support body 26 in the rotary body 25, and the transmission-reception antenna 202 having an arrangement surface area wider than the arrangement surface area of the memory antenna 331 may be arranged in a plane opposite the rotary member 25 in the support body 26. The same effect can be obtained in all of those cases.

F. Other Embodiments

In addition to the above-described printing processing, the printing processing reflecting the paper-related information also includes the following printing processing.

(1) Of the paper-related information, paper type information and roll paper size information can be used, and when the paper type and printing paper size which have been set in the GUI displayed on the display of computer PC are different from the paper type and printing paper size that have been acquired, a report can be made via the GUI to the effect that the setting on the GUI is inappropriate.

(2) Paper-related information may be read out and optimum printing settings may be automatically set in the roll paper member 30 that has been installed. In such a case, printing processing with respect to the roll paper member 30 that has been installed can be executed under optimum printing conditions, without setting the printing conditions via the GUI on the display of computer PC.

(3) Of the paper-related information, the production year, month, and date may be read and a decision may be made as to whether or not it is within the warranty period. In such a case, the user can be informed in advance about the degradation of printing quality due to changes in the service life of the roll paper member 30. The user can use the roll paper member 30, about which he has been informed, for example, for proof printing.

(4) Of the paper-related information, paper thickness may be used and the platen gap may be automatically adjusted. In such a case, the appropriate platen gap can be set for each roll paper member 30 and the appropriate paper feed can be implemented.

(5) Information on the resistance of roll paper to ambient conditions may be stored as the paper-related information, and moisture and temperature sensors may be provided in the printer body 10. In such a case, the user may be informed when the measured temperature and moisture are not within the printing conditions that can guarantee the appropriate printing results for the installed roll paper.

(6) A production lot number may be used as the paper-related information and color correction may be executed which reflects the characteristics of roll paper presented for each lot. Characteristics (paper type) of roll paper sometimes vary significantly between the production lots. In such a case, spread of printing results between the production lots can be reduced in advance by executing color correction that takes account of the characteristics of roll paper which is being used.

(7) Paper feed sequence may be stored as the paper-related information and the paper feed control may be executed which is based on the paper feed sequence stored for each roll paper. In such a case, paper feed control taking account of the roll paper type can be executed and more appropriate printing results can be obtained.

The roll paper printing system in accordance with the present invention has been explained above based on several embodiments, but the above-described preferred embodiments of the present invention are used merely to facilitate the understanding of the present invention and they place no limitation on the present invention. The present invention can be changed or modified without departing from the essence thereof and the scope of the claims, and it goes without saying that the present invention also includes the equivalents thereof.

For example, in the first and second embodiments, the printing system for roll paper in accordance with the present invention was explained by employing color printers CP, CP2 which can use both the cut paper and the roll paper member 30. However, it goes without saying that the printing system for roll paper in accordance with the present invention is also applicable to printers designed specifically for roll paper.

In the second embodiment, the transmission-reception circuit 210 was provided inside the roll paper support shaft 200 to transmit paper-related information to the printer body 10 and receive it therefrom. However, a configuration may be used in which the transmission-reception circuit 120 is provided only in the printer body 10, a non-contact IC memory module 33 is provided in the roll paper member 30, and the IC memory module 33 is directly accessed from the printer body 10. In such a case, the additional configuration necessary for reading and writing the paper-related information to and from the memory provided in the roll paper member 30 can be held to a minimum additional configuration and cost can be reduced.

In the above-described embodiment, printing conditions in the color printer CP, CP2 were set via the personal computer PC, but setting of printing conditions may be also executed only in the color printer CP, CP2. Furthermore, a configuration may be also used in which an application (driver) for using the paper-related information is stored in the IC memory module 33 or memory element 35 and when the roll paper member 30 is used for the first time, the application is installed in the personal computer PC or color printer CP, CP2. In such a case, printing processing that reflects the paper-related information stored in the IC memory module 33 or memory element 35 can be executed, regardless of whether or not the necessary application has been installed in advance in a personal computer PC or the like.

In the above-described embodiments, color printers CP, CP2 have been used as printing devices. However, no specific limitation is placed on the printing device, provided that it can conduct printing to roll paper. For example, the present invention may be applied to monochromatic printers, laser printers, fax machines, and the like.

In the above-described embodiments, the paper feed quantity was determined based on the rotation angle of the paper feed motor 43 (platen 42), which is detected by the encoder 47. However, detection wires may be printed per each unit length (for example, 1 mm) on the rear surface edge of the roll paper 32 for printing of the roll paper member 30, the number of detection wires that have passed may be detected with an optical reading sensor, and the paper feed quantity may be computed based on the detected number of wires that have passed.

In the above-described embodiments, the paper feed quantity was determined based on the rotation angle of the paper feed motor 43 (platen 42), which is detected by the encoder 47. However, the paper feed quantity may be also computed based on the paper feed quantity signal transmitted from the personal computer PC to the color printers CP, CP2.

In the above-described embodiments, the remaining quantity of paper was stored in the IC memory module 33 or memory element 35. However, the used quantity of paper may be stored instead of the remaining quantity of paper. In such a case, the operation effect can be obtained which is similar to that obtained when the remaining quantity of paper was used.

In the above-described embodiments, the case was explained in which paper-related information was stored in the IC memory module 33. However, for example, a weight sensor WS may be provided in the case 36 and the remaining quantity (used quantity) of roll paper 321 for printing may be detected based on the weight detected by the weight sensor WS. Alternatively, a position sensor PS for linearly detecting the height (thickness) of roll paper 321 for printing may be provided on the side wall of case 36 and the remaining quantity (used quantity) of roll paper 321 for printing may be detected based on the height of the roll paper 321 for printing that has been detected with the position sensor PC. The conventional sensors can be used as the weight sensor and position sensor.

When the core 31 of roll paper member 30 has a flange portion covering the end surface of roll paper member 30, the memory antenna 331 may be arranged in the flange portion of core 31.

What is claimed is:

1. A printing device for printing to a roll paper, which is provided with a memory device for rewritably storing at least one of a remaining quantity of roll paper and a type of roll paper as information relating to the roll paper, said printing device comprising:

a holder unit holding said roll paper; and a printing controller that determines a quantity of said roll paper to be fed for printing according to at least any one of said remaining quantity of roll paper and said type of roll paper stored in said memory device;

wherein when said printing control device makes a decision that the printing processing of printing data quantity to be printed cannot be completed with said remaining quantity of said roll paper for printing, which is stored, based on said printing data quantity which has to be printed and said remaining quantity of said roll paper for printing stored in said memory device, said printing control device interrupts the printing processing and outputs a signal.

2. A printing device according to claim 1, wherein said printing controller calculates an amount of a back tension force of the roll paper reflecting said remaining quantity of said roll paper, and determines the paper feed quantity according to the calculated amount of back tension force.

3. A printing device according to claim 1, further comprising:

an information input-output device for executing in a non-contact mode writing and reading of said information relating to said roll paper with respect to said memory device.

4. A printing device according to claim 1, further comprising:

an information input-output device for executing in a contact mode writing and reading of said information relating to said roll paper with respect to said memory device.

5. A printing device according to claim 1, wherein said printing controller so determines the paper feed quantity as to be increased when the remaining quantity of said roll paper is large or said roll paper has good sliding properties according to said information stored in said memory device.

6. A printing device according to claim 1, wherein said type of roll paper includes sliding properties for the roll paper, and said printing controller determines the paper feed quantity according to the sliding properties.

7. A printing device according to claim 1, wherein said memory device covers at least a portion of a periphery of a core of said roll paper.

8. A roll paper printing system comprising:

a roll paper for printing;

a roll paper member comprising detection means for detecting a remaining quantity of said roll paper for printing, and also comprising a memory device and a printing device provided with printing control means for determining a quantity of said roll paper to be fed for printing based on said remaining quantity of roll paper that has been detected;

wherein when said printing control device makes a decision that the printing processing of printing data quantity to be printed cannot be completed with said remaining quantity of said roll paper for printing, which is stored, based on said printing data quantity which has to be printed and said remaining quantity of said roll paper for printing stored in said memory device, said printing control device interrupts the printing processing and outputs a signal.

9. A printing device according to claim 8, wherein said memory device is provided on a core of said roll paper member for rewritably storing a remaining quantity of said roll paper.

* * * * *